US007632121B2

(12) United States Patent
Gonzales et al.

(10) Patent No.: US 7,632,121 B2
(45) Date of Patent: Dec. 15, 2009

(54) COAXIAL CONNECTOR

(75) Inventors: Olivier Gonzales, Saint Aupre (FR); Fabien Bourgeas, Saint Nicolas de Macherin (FR)

(73) Assignee: Radiall, Rosny sous Bois (FR)

( * ) Notice: Subject to any disclaimer, the term of this patent is extended or adjusted under 35 U.S.C. 154(b) by 0 days.

(21) Appl. No.: 11/790,402

(22) Filed: Apr. 25, 2007

(65) Prior Publication Data

US 2007/0264853 A1 Nov. 15, 2007

(30) Foreign Application Priority Data

May 15, 2006 (FR) ..... 06 51730

(51) Int. Cl.
*H01R 29/00* (2006.01)

(52) U.S. Cl. ..... 439/188; 439/578; 439/944; 439/823; 439/349; 200/51.1

(58) Field of Classification Search ..... 439/349, 439/347, 352, 188, 944, 578, 581–583, 823; 200/51.1

See application file for complete search history.

(56) References Cited

U.S. PATENT DOCUMENTS 5,151,040 A * 9/1992 Tanaka ..... 439/73
5,195,904 A * 3/1993 Cyvoct ..... 439/349
5,562,464 A * 10/1996 Lecourtois ..... 439/188
6,696,850 B1 * 2/2004 Sanders ..... 324/761
6,872,091 B2 * 3/2005 Huang ..... 439/578
6,935,906 B2 * 8/2005 Orihara ..... 439/824
2003/0082942 A1 5/2003 Wlos

FOREIGN PATENT DOCUMENTS

DE 92 15 031 U1 1/1993
FR 2 712 433 A1 5/1995

* cited by examiner

*Primary Examiner*—Xuong M Chung-Trans
(74) *Attorney, Agent, or Firm*—Oliff & Berridge, PLC

(57) ABSTRACT

A coaxial connector with a first connector element forming a socket, having a first body, a resilient return member, and a first central contact element having a first front end, the contact element being movable against the action of a resilient return member, at least in sliding relative to the first body; and a second connector element forming in particular a plug, arranged to be capable of being releasably connected to the first connector element, and the second connector element having a second body and a second central contact element with a second front end; the first and second central contact elements are arranged in such a manner that when the first and second connector elements are connected together, the contact elements bear one against the other via their front ends.

5 Claims, 2 Drawing Sheets

Fig.1
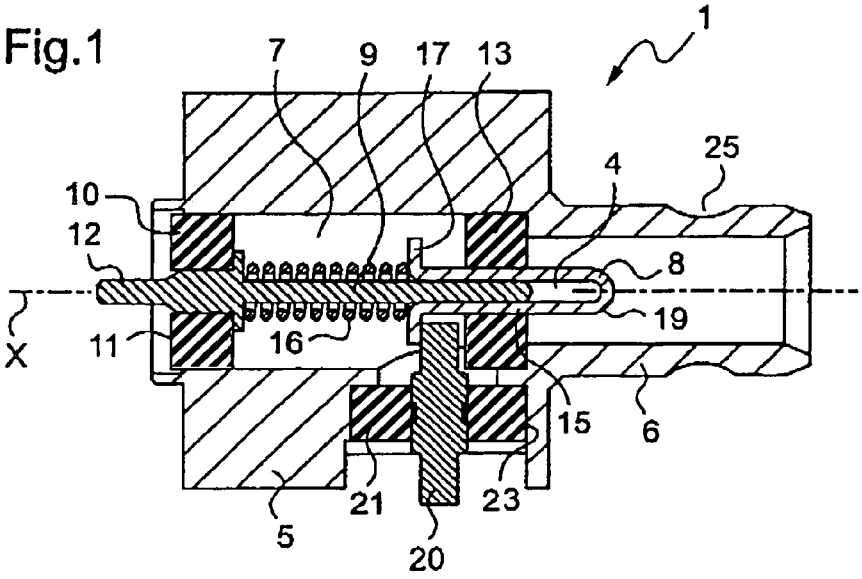
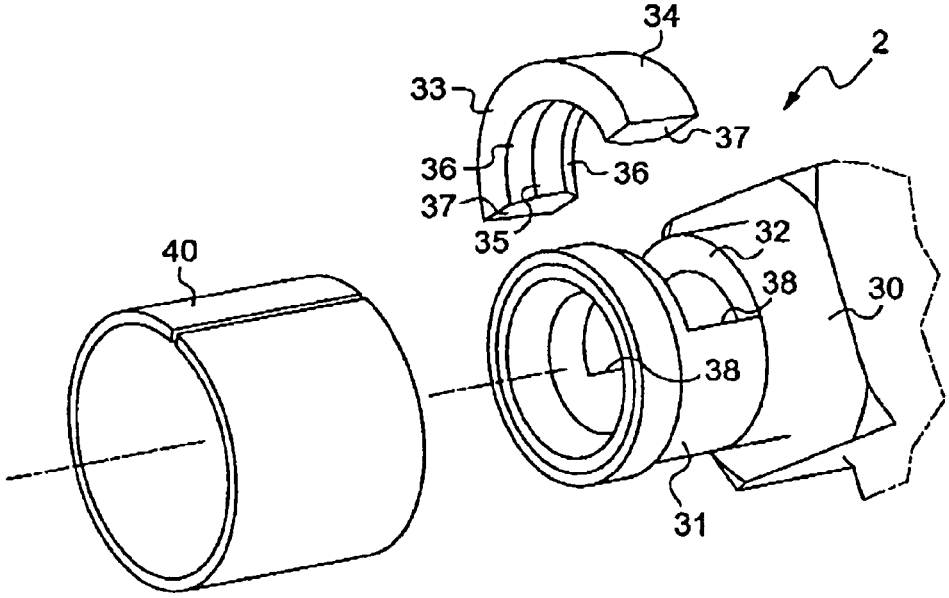
Fig.2

Fig.6
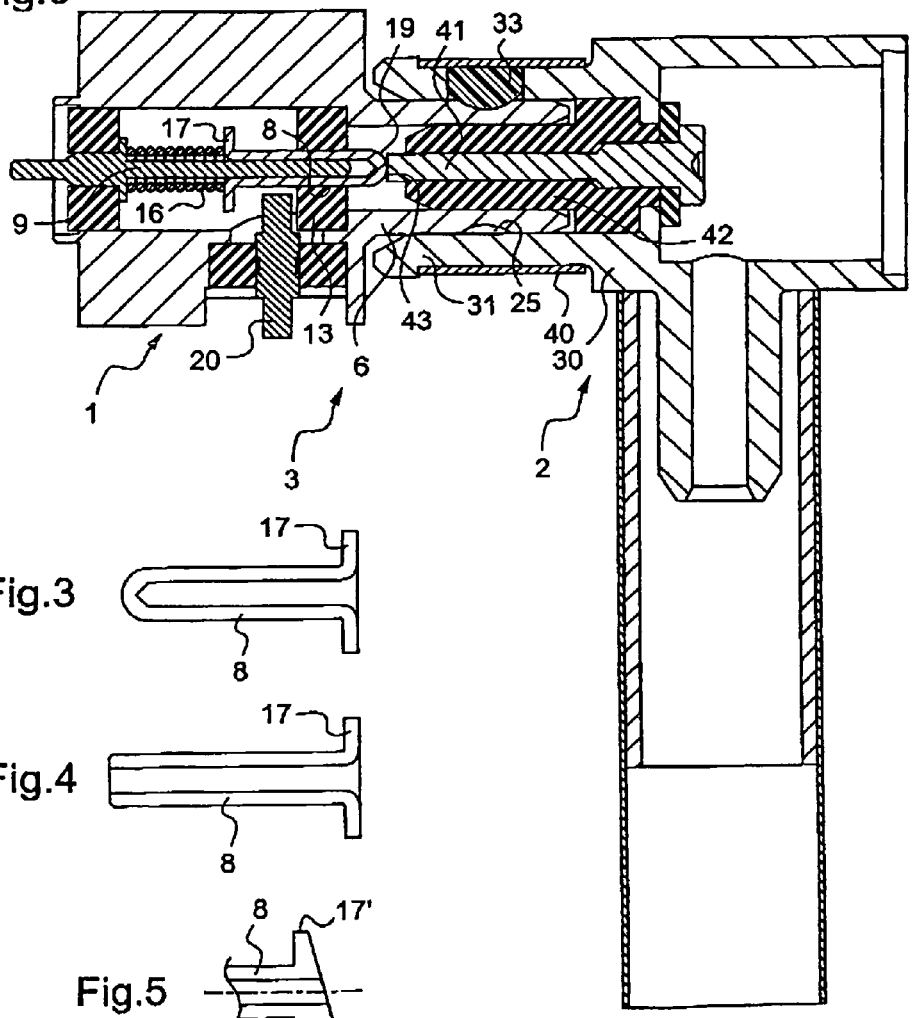
Fig.3
Fig.4
Fig.5
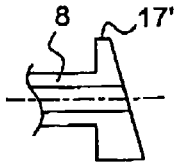
Fig.7
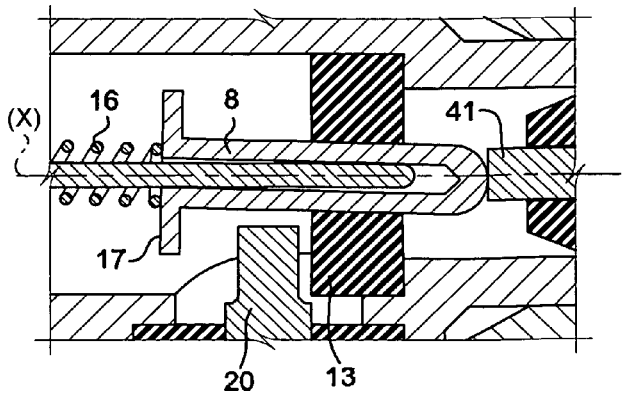

COAXIAL CONNECTOR

BACKGROUND

The mechanical endurance of such a connector, limited by the wear caused during insertion and extraction operations at the interface between the connector elements, in particular at the central contact elements, corresponds typically to about 500 insertion-extraction cycles.

It is known to improve the mechanical endurance of such a connector by making the contact between the connector elements less aggressive, e.g. by reducing the pressure exerted on the various portions of the connector element and by attenuating the roughnesses of the contact surfaces, e.g. by rounding certain corners.

It is also known to use surface treatments that make the components better at withstanding wear.

Nevertheless, such techniques are of limited effectiveness and mechanical endurance generally does not exceed 5000 insertion-extraction cycles.

SUMMARY

The invention seeks to further increase the mechanical endurance of a coaxial connector.

The invention thus provides a coaxial connector comprising:

- a first connector element forming a socket, having a first body, a resilient return member, and a first central contact element having a first front end, the contact element being movable against the action of a resilient return member, at least in sliding relative to the first body; and
- a second connector element forming in particular a plug, arranged to be capable of being releasably connected to the first connector element, and comprising a second body and a second central contact element having a second front end.

The first and second central contact elements are arranged in such a manner that when said first and second connector elements are connected together, these contact elements bear one against the other via their front ends.

The first connector element includes a guide pin for guiding the first contact element, and the first contact element includes a recess in which the pin engages. The pin is stationary relative to the first body.

The guide pin presents a longitudinal axis and the first contact element can tilt relative to the guide pin on said longitudinal axis.

The first central contact element and the resilient return member are arranged in such a manner that the resilient return member exerts on the first contact element a force that is not colinear with the longitudinal axis of the pin, thus serving in particular to cause the contact element to tilt relative to the pin.

This makes it possible to ensure satisfactory electrical contact between the elements for connecting together.

By means of the invention, the mechanical endurance of the connector can be improved substantially, making more than 40,000 insertion-extraction cycles possible.

The central contact elements can be put into contact without rubbing against each other when the two elements of the connector are connected together, thus making it possible to avoid wear, and thus damage, to the metal-metal surfaces used for transmitting the electric signal.

The invention also makes it possible to limit friction during disconnection of the elements of the connector.

By way of example, the resilient return member may be a helical spring provided in particular with a portion of a turn bearing against the first contact element and arranged to exert thereon a force that is not colinear with the longitudinal axis of the guide pin.

The first contact element may have a shoulder, in particular an annular shoulder, against which the resilient return member bears.

The shoulder may present a shape that is chamfered, serving to direct a fraction of the return force in a direction that is perpendicular to the longitudinal axis of the guide pin.

At least one of the first central contact elements and the guide pin may present a cross-section that is circular, or in a variant a cross-section that is not circular, e.g. that is polygonal.

The first connector element may include an insulating insert provided with an opening in which the first central contact element is engaged.

When it is necessary to perform a switching function, the first connector element may include a side contact element.

In an embodiment of the invention, when the first connector element is disconnected, being in a non-switched configuration, the central contact element may bear against the side contact element. The electric signal can then pass from the guide pin to the side contact element via the sliding contact element, these elements defining a portion of a coaxial line.

The resilient return member is advantageously prestressed so as to generate sufficient force between the central and side contact elements and reduce the electrical resistance at the interface between these contact elements.

The side contact element may be held on the first body by means of an insulating insert.

The insulating insert is provided with an opening in which the first central contact element engages, and it may be arranged to take up a fraction of the force exerted by the resilient return member, thus making it possible to avoid excessive pressure on the side contact element.

According to another aspect of the invention, the second connector element includes a shoe arranged to co-operate with the first connector element in order to prevent the two connector elements from moving relative to each other, at least axially, when they are connected together.

Holding the two connector elements together by means of the shoe enables wear to be reduced during insertion-extraction cycles.

The invention can make it possible in particular to avoid using a split connection portion on one of the connector elements, where such a connection portion leads to relatively aggressive friction.

The second connector body may include a side housing for receiving the shoe.

By way of example, the second connector element may include a split ring for holding the shoe in the housing.

When the second connector body presents a longitudinal axis, the shoe may present an inside cross-section perpendicular to said longitudinal axis, that is substantially circularly arcuate, and in particular that is semicircular.

Where appropriate, the shoe may be chamfered and/or grooved in its inside face.

If so desired, the shoe may be substantially crescent-shaped, with inside and outside cylindrical faces that do not share a common axis, thus making it possible in particular to locate the interface between the shoe and the body of the socket over a small area, thereby making insertion easier.

The shoe may be made of a plastics material having a low coefficient of friction, such as, for example: polytetrafluoroethylene; a polyamide; or a polypropylene, this list not being limiting.

In an embodiment of the invention, the first connector body comprises a connection portion, in particular a cylindrical connection portion, that is provided with a groove, in particular an annular groove, in which the shoe can engage at least in part when the two connector elements are connected together, in particular for the purpose of increasing the retention force between the two connector elements.

The groove may be substantially complementary in shape to the shape of the inside face of the shoe.

A socket formed by the first connector element may be used in a wireless communications terminal in order to direct a radiofrequency signal towards an external outlet when the plug formed by the second connector element is inserted in the socket.

The invention also provides a coaxial type connector element, in particular for a connector as defined above, the connector element comprising:

the body;

a resilient return member;

a central contact element having a front end, said contact element being movable, at least in sliding, relative to the body against the action of the resilient return member; and a guide pin for guiding the contact element, which element includes a recess in which the pin is engaged.

The invention also provides a coaxial type connector element, in particular of a connector as defined above, the element comprising:

a body;

a central contact element; and a shoe disposed in a side housing of the body.

BRIEF DESCRIPTION OF THE DRAWINGS

The invention can be better understood on reading the following detailed description of non-limiting embodiments of the invention and on examining the accompanying drawings, in which:

FIG. 1 is a diagrammatic and fragmentary longitudinal section view showing a first connector element in accordance with the invention;

FIG. 2 is a diagrammatic and fragmentary perspective view showing various elements of a second connector element in accordance with the invention;

FIGS. 3 to 5 are diagrammatic and fragmentary views showing various examples of the contact elements of the first connector element shown in FIG. 1;

FIG. 6 is a diagrammatic and fragmentary view of a connector made up of the first and second connector elements of FIGS. 1 and 2; and FIG. 7 is a diagrammatic and fragmentary view showing the tilting of the contact element of FIG. 3 relative to the longitudinal axis of the pin.

MORE DETAILED DESCRIPTION

FIGS. 1 and 2 show respectively first and second connector elements 1 and 2 of a coaxial connector 3 in accordance with the invention.

The connector element 1 forms, for example, a socket used in a wireless communications terminal.

The socket 1 is used in particular to direct a radio frequency signal to an external outlet when a coaxial plug formed by the connector element 2 is inserted in the socket 1.

In the example described, the connector 3 has a switching function.

The connector element 1 comprises a first body 5 of longitudinal axis X, e.g. made of a copper alloy such as brass and having a substantially cylindrical connection portion 6.

The body 5 also has a cavity 7 extending the connection portion 6 and is arranged to receive a first central contact element 8.

In the example described, this contact element 8 is substantially cylindrical in shape, having a cross-section that is circular.

In a variant, the contact element 8 could present a cross-section that is not circular, e.g. that is polygonal in shape.

The contact element 8 presents a recess 4 enabling it to be engaged on a guide pin 9 of axis X.

The pin is held in the cavity 7 by means of an insulating insert 10 which includes a passage 11 for receiving a rear portion 12 of the pin 9.

By way of example, the pin 9 and the contact elements 8 are made of a copper alloy such as brass.

Another insulating insert 13 is provided in the cavity 7 at its end remote from the end having the insulating insert 10. The insert 13 presents an opening 15 for the contact element 8.

The insert 10 and 13 are made of polytetraflouroethylene (PTFE), for example.

The contact element 8 can slide on the pin 9 against the action of a resilient return member 16.

In the example described, the resilient return member 16 is formed by a helical spring inserted around the guide pin 9.

The spring 16 has one end bearing against a shoulder 17 of the contact element 8.

In the example shown in FIGS. 1 and 3, the contact element 8 is closed at its front end 19 remote from the shoulder 17.

In a variant, and as shown in FIG. 4, the contact element 8 may be open at its front end 19.

The shoulder 17 may extend substantially perpendicularly to the longitudinal axis X of the pin 9, as shown in FIGS. 3 and 4.

In a variant, as shown in FIG. 5, the contact element 8 may present a shoulder 17' that is chamfered in shape, serving to direct a fraction of the return force in a direction that is perpendicular to the axis X.

The dimensions and/or the shape of the contact element 8 and of the pin 9 are selected in such a manner that the contact element 8 can tilt through a certain angle relative to the longitudinal axis X of the pin 9, as shown in FIG. 7.

The connector element 1 also has a side contact element 20 extending perpendicularly to the axis X and secured to an insulating insert 21 received in an opening 23 of the body 5.

When the connector element 1 is disconnected, in a non-switched configuration, as shown in FIG. 1, the contact element 8 comes to bear against the side contact element 20 via its shoulder 17.

The prestressed resilient return member 16 exerts sufficient force on the contact element 8 to provide satisfactory contact between said contact element 8 and the side contact element 20.

The connection portion 6 has an annular groove 25 that performs a function described below.

As shown in FIG. 2, the second connector element 2 comprises a body 30, e.g. made of a copper alloy such as brass, provided with a connection portion 31 that is substantially cylindrical.

This portion 31 includes a side housing 32 presenting a cross-section that is substantially semicircular, and arranged to receive a shoe 33, e.g. made of a plastics material having a low coefficient of friction, such as, for example: polytetrafluoroethylene; a polyamide; or a polypropylene, this list not being limiting.

The shoe 33 has outside and inside faces 34 and 35, the face 35 projecting into the cylindrical connection portion 31 when the shoe 33 is received in the housing 32.

The outside face 34 is substantially semicylindrical in shape.

The inside face 35 presents a cross-section that is substantially semicircular and that includes chamfers 36.

The shoe 33 bears via its end faces 37 on supports 38 formed on the connection portion 31.

The shoe 33 is held in the housing 32 by means of a split ring 40, e.g. made of a material having a high elastic limit such as a stainless steel, that is inserted with a small amount of elastic deformation around the connection portion 31 and the shoe 33, as can be seen in FIG. 6.

The second connector element 2 also has a central contact element 41 held in the connection portion 31 by means of an insulating insert 42.

The central contact element 41 presents a front end 43 that is in the form of a substantially plane face, in the example described.

The connector elements 1 and 2 are connected together as follows in order to constitute the connector 3.

The connection portion 6 of the connector element 1 is inserted into the connection portion 31 of the connector 2 so as to engage the shoe 33 in the annular groove 25 of the connection portion 6, thus enabling the two connector elements 1 and 2 to be secured to each other.

During connection, the central contact elements 8 and 41 come to bear one against the other via their respective front ends 19 and 43, as shown in FIG. 6.

This bearing force causes the contact element 8 to slide and possibly to tilt relative to the guide pin 8 against the action of the spring 16.

The reverse movement of the contact element 8 moves the shoulder 17 away from the side contact element 20, thus causing the connector element 1 to switch.

The insulating insert 13, serving in particular to guide the moving contact element 8, serves to take up the force exerted by the spring 16, which can make it possible to avoid excessive rotation of the side contact element 20.

This can provide reliable contact between the contact element 8 and the side contact element 20, even after the insulating insert 21 has suffered from aging.

The connector elements 1 and 2 are likewise disconnected with very low levels of friction between them.

Naturally, the invention is not restricted to the embodiments described above.

The shoe 33 can be held on the connection portion 31 in any other manner, e.g. by means of an adhesive or by heat-sealing.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A coaxial connector comprising:

a first connector element forming a socket, the first connector element comprising:

a first body;

a resilient return member;

a first central contact element that is closed at a first front end, and has a recess and an annular shoulder;

a side contact element; and a guide pin, wherein:

the guide pin guides the first central contact element by engaging the recess of the first central contact element such that the first central contact element is stationary relative to the first body, the first central contact element being movable against the action of the resilient return member, at least in sliding relative to the first body, the resilient return member comprises a helical spring provided with a portion of a turn in contact with the annular shoulder of the first central contact element, the first central contact element and the resilient return member are arranged in such a manner that the resilient return member exerts on the first central contact element a force that is not colinear with a longitudinal axis of the guide pin, making the force capable of tilting the first central contact element relative to the guide pin, and when the first connector element is disconnected, the first central contact element contacts the side contact element; and a second connector element forming in particular a plug, and arranged to be capable of being releasably connected to the first connector element, the second connector element comprising:

a second body;

a second central contact element having a second front end; and a shoe arranged to co-operate with the first connector element so as to prevent the two connector elements from axially moving relative to each other when they are connected together, wherein:

the second connector body includes a lateral housing arranged to receive the shoe, the second connector element includes a split ring arranged to hold the shoe in the housing, and the first and second central contact elements being arranged in such a manner that when the first and second connector elements are connected together, the first and second central contact elements bear one against the other via their front ends.

2. A connector according to claim 1, wherein at least one of the first contact elements and the guide pin presents a cross-section that is circular.

3. A connector according to claim 1, wherein the first connector element includes an insulating insert provided with an opening in which the first central contact element engages.

4. A connector according to claim 1, the second connector body presenting a longitudinal axis, wherein the shoe presents an inside cross-section perpendicular to said longitudinal axis that is substantially semicircularly arcuate.

5. A connector according to claim 1, wherein the first connector body includes a connection portion in particular a cylindrical portion, that is provided with an annular groove, in which the shoe can engage at least in part when the two connector elements are connected together.

* * * * *